US008146675B2

(12) United States Patent
Gross et al.

(10) Patent No.: US 8,146,675 B2
(45) Date of Patent: Apr. 3, 2012

(54) PORTABLE FIRE EXTINGUISHING APPARATUS AND METHOD

(75) Inventors: Marc V. Gross, Shorewood, MN (US); Lawrence T. Weinman, Austin, TX (US); Bruce G. Van Stratum, Tallahassee, FL (US)

(73) Assignee: Fireaway LLC, Minnetonka, MN (US)

( * ) Notice: Subject to any disclaimer, the term of this patent is extended or adjusted under 35 U.S.C. 154(b) by 0 days.

(21) Appl. No.: 12/946,569

(22) Filed: Nov. 15, 2010

(65) Prior Publication Data

US 2011/0056711 A1 Mar. 10, 2011

Related U.S. Application Data

(63) Continuation of application No. 12/299,569, filed as application No. PCT/US2007/010699 on May 1, 2007, now Pat. No. 7,832,493, application No. 12/946,569, which is a continuation-in-part of application No. PCT/US2007/000893, filed on Jan. 12, 2007, which is a continuation-in-part of application No. 11/417,863, filed on May 4, 2006, now abandoned.

(51) Int. Cl.
*A62C 13/22* (2006.01)
*A62C 13/02* (2006.01)

(52) U.S. Cl. ..... 169/84; 169/30

(58) Field of Classification Search ..... 169/26, 169/28–30, 36, 43, 46, 47, 54, 84, 88, DIG. 3; 102/229, 236, 261, 368
See application file for complete search history.

(56) References Cited

U.S. PATENT DOCUMENTS

| | | | |
|---|---|---|---|
| 1,510,843 | A | 10/1924 | Hawkins |
| 1,588,234 | A | 6/1926 | Kauch |
| 1,774,952 | A | 9/1930 | Thiecke |
| 1,878,491 | A | 9/1932 | Goss |
| 2,838,122 | A | 6/1958 | Hutchinson |
| 2,873,806 | A | 2/1959 | Bittner |
| 3,380,383 | A | 4/1968 | Snenepfe, Jr. |
| 3,613,794 | A | 10/1971 | Naumann et al. |
| 3,724,381 | A | 4/1973 | Gawlick et al. |
| 3,785,569 | A | 1/1974 | Helmrich |
| 3,833,063 | A | 9/1974 | Williams |
| 4,197,213 | A | 4/1980 | Pietz et al. |
| 4,436,159 | A | 3/1984 | Revay |

(Continued)

FOREIGN PATENT DOCUMENTS

EP 750924 1/1997

(Continued)

OTHER PUBLICATIONS

"U.S. Appl. No. 11/234,733, Non Final Office Action mailed Oct. 19, 2006", 9 pgs.

(Continued)

*Primary Examiner* — Darren W Gorman
(74) *Attorney, Agent, or Firm* — Schwegman, Lundberg & Woessner, P.A.

(57) ABSTRACT

A fire suppression device including a fire suppression agent generator. The device further includes trigger mechanism adapted to begin generation of the fire suppression agent from the fire suppression agent generator. A container at least partially surrounds the fire suppression agent generator and the trigger mechanism, the container includes a discharge port that directs fire suppression agent in at least two opposed directions. In one example, the discharge port extends substantially around a perimeter of the container.

22 Claims, 8 Drawing Sheets

U.S. PATENT DOCUMENTS

| | | | |
|---|---|---|---|
| 4,843,965 | A | 7/1989 | Merzals |
| 4,976,201 | A | 12/1990 | Hamilton |
| 5,423,384 | A | 6/1995 | Galbraith et al. |
| 5,425,426 | A | 6/1995 | Baratov et al. |
| 5,613,562 | A | 3/1997 | Galbraith et al. |
| 5,660,236 | A | 8/1997 | Sears et al. |
| 5,865,257 | A | 2/1999 | Kozyrev et al. |
| 5,884,710 | A | 3/1999 | Barnes et al. |
| 5,915,480 | A | 6/1999 | Yemelyanov et al. |
| 5,927,082 | A | 7/1999 | Sidelnikov et al. |
| 5,992,528 | A | 11/1999 | Parkinson et al. |
| 6,024,889 | A | 2/2000 | Holland et al. |
| 6,042,664 | A | 3/2000 | Kozyrev et al. |
| 6,089,326 | A | 7/2000 | Drakin |
| 6,116,348 | A | 9/2000 | Drakin |
| 6,264,772 | B1 | 7/2001 | Drakin |
| 6,595,139 | B1 | 7/2003 | Haeselich |
| 6,622,801 | B1 | 9/2003 | Rondino |
| 6,689,285 | B2 | 2/2004 | Rusin et al. |
| 7,389,825 | B2 | 6/2008 | Gross |
| 7,461,701 | B2 | 12/2008 | Gross et al. |
| 7,614,458 | B2 | 11/2009 | Gross |
| 7,832,493 | B2 | 11/2010 | Gross et al. |
| 2004/0262017 | A1 | 12/2004 | Gaidano et al. |
| 2007/0068683 | A1 | 3/2007 | Pavesi |
| 2007/0068687 | A1 | 3/2007 | Pavesi |
| 2007/0163787 | A1 | 7/2007 | Posson et al. |
| 2007/0235200 | A1 | 10/2007 | Gross |
| 2007/0245918 | A1 | 10/2007 | Gross |
| 2007/0246229 | A1 | 10/2007 | Gross |
| 2009/0301738 | A1 | 12/2009 | Gross et al. |

FOREIGN PATENT DOCUMENTS

| | | | |
|---|---|---|---|
| EP | 1479414 | A1 | 11/2004 |
| GB | 271363 | | 5/1927 |
| GB | 2161379 | | 1/1986 |
| GB | 2299020 | | 9/1996 |
| WO | WO 9315793 | A1 * | 8/1993 |
| WO | WO-2007040561 | A1 | 4/2007 |
| WO | WO-2007130498 | A2 | 11/2007 |
| WO | WO-2007130498 | A3 | 11/2007 |
| WO | WO-2008057139 | A2 | 5/2008 |
| WO | WO-2008057139 | A3 | 5/2008 |

OTHER PUBLICATIONS

"U.S. Appl. No. 11/417,863, Non Final Office Action mailed Jan. 30, 2007", 9 pgs.

"U.S. Appl. No. 12/299,569, Preliminary Amendment filed Nov. 4, 2008", 11 pgs.

"Micro-K Aerosol Technology", (c) 1997 Ansul Incorporation, (1997), 25 pgs.

Fletcher, M., "Fighting Fire with Fire", Eureka, Findlay Publications LTD., vol. 20, No. 1, (Jan. 1, 2000), p. 17 only.

"Aero-K(r) Fire Suppression Systems", Brochure, Sensor Electronics Corporation, Minneapolis, MN, USA, (before Jan. 2006), 6 pgs.

"U.S. Appl. No. 12/299,569 Notice of Allowance mailed Sep. 23, 2010", 10 pgs.

"FP-1000M", Technical Data Sheet, Celanova Limited Fire-Pro, (Nov. 27, 2003).

"International Search Report, International Application No. PCT/US05/41944", (Nov. 1, 2006).

"International Application Serial No. PCT/US2007/008698, Search Report mailed May 27, 2008", P220, 6pgs.

"International Application Serial No. PCT/US2007/008698, Written Opinion mailed May 27, 2008", P237, 5pgs.

"International Application Serial No. PCT/US2007/010699, Search Report mailed May 27, 2008.", P220, 5 pgs.

"International Application Serial No. PCT/US2007/010699, Written Opinion mailed May 27, 2008.", P237, 5 pgs.

* cited by examiner

PORTABLE FIRE EXTINGUISHING APPARATUS AND METHOD

RELATED APPLICATION

This application is a continuation and claims priority benefit of U.S. patent application Ser. No. 12/299,569 filed Apr. 6, 2009 which is a national stage application and claims priority benefit of PCT Application Ser. No. PCT/US2007/010,699 filed May 1, 2007. This application is a continuation-in-part and claims priority benefit of PCT Application Ser. No. PCT/US2007/000893 filed Jan. 12, 2007, which is a continuation-in-part of U.S. patent application Ser. No. 11/417,863 filed May 4, 2006. All of said applications are incorporated herein by reference.

TECHNICAL FIELD

Fire extinguishing devices, and in particular portable fire extinguishing devices.

BACKGROUND

Self contained fire extinguishing assemblies are used to extinguish fires in enclosed volumes. In some examples, the assemblies are mounted within the enclosed volumes (rooms, warehouses and the like), and rigged to automatically operate in the presence of predetermined stimulus (e.g., heat, concentration of a gas and the like). In at least one example, the assembly is electrically powered, and remote fire detectors control the activation of the assembly. For instance, the remote fire detectors activate a series of fire extinguishing assemblies in areas where fire is detected. Preinstalled fire extinguishing assemblies are cumbersome and difficult to move between locations as the assemblies are often heavy and fixedly coupled to a structure at a first location. Additionally, it is difficult to position the assemblies within an on-going fire because of the extreme heat, noxious gases and possible degradation of the location's structural integrity.

Another example of a fire extinguishing assembly includes a hand held device that immediately ignites an aerosol forming compound upon the removal of a safety pin. Because the aerosol forming compound immediately ejects fire suppressant from the device, injury may result. Further, because of the ejecting fire suppressant, in some examples, it is difficult to properly position the hand held device within a burning enclosed space where it can work most effectively. In other examples, the hand held device includes a discharge orifice that upon positioning in the desired burning location becomes occluded by surrounding debris or the floor. Occluding the discharge orifice prevents ejection of the fire suppressant and decreases the effectiveness of the hand held device. Further still, in yet other examples, the discharge orifice creates sufficient thrust to propel the hand held device away from the desired location (e.g., adjacent a fire) thereby decreasing the effectiveness of the device. For instance, the device generates sufficient thrust to propel itself from the desired location through a window or door or into a distant corner away from a burning area. To avoid such thrust, the device container must have sufficient weight to counter the thrust. However, using a heavy container makes it difficult to transport and position the fire extinguishing device.

Still other examples of fire extinguishing assemblies use a liquid based aerosol, such as a water base, to generate the fire suppression agent. A sufficient amount of liquid must be included in a reservoir within the assemblies to extinguish the desired fire. The liquid can be heavy and limit the portability of the assemblies, especially for use by a single user. In addition to the liquid reservoir, to form a liquid based aerosol an explosive device is required to create sufficient explosive energy to force the liquid through atomizing openings and generate the liquid aerosol fire suppression agent. The container for such an assembly must be enlarged to contain the explosive device and the liquid reservoir. Additionally, the container is strengthened (e.g., with stronger materials and/or additional reinforced structure) to withstand such an explosion thereby making the assembly heavier and more cumbersome for the user.

What is needed is a fire extinguishing device that overcomes the shortcomings of previous devices. What is further needed is a fire extinguishing device that is compact and portable, and is easily positionable within a burning area.

BRIEF DESCRIPTION OF THE DRAWINGS

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

DESCRIPTION OF THE EMBODIMENTS

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, logical and electrical changes may be made without departing from the scope of the present invention. The following detailed description is, therefore, not to be taken in a limiting sense, and the scope of the present invention is defined by the appended claims and their equivalents.

In this document, the terms "a" or "an" are used, as is common in patent documents, to include one or more than one. In this document, the term "or" is used to refer to a nonexclusive or, such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Figure 1:
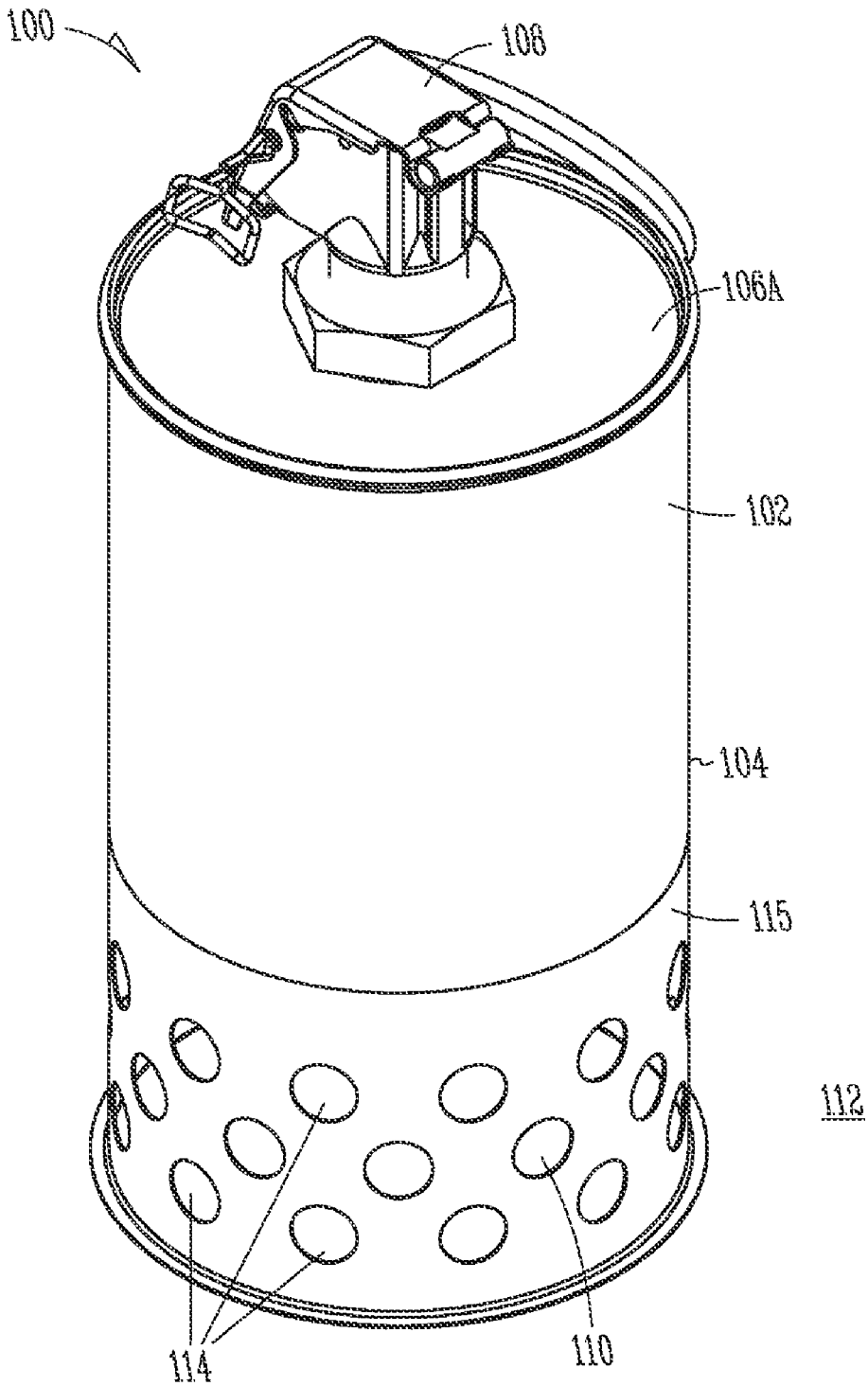
FIG. 1 is a perspective view of one example of a fire suppression device.
Figure 2:
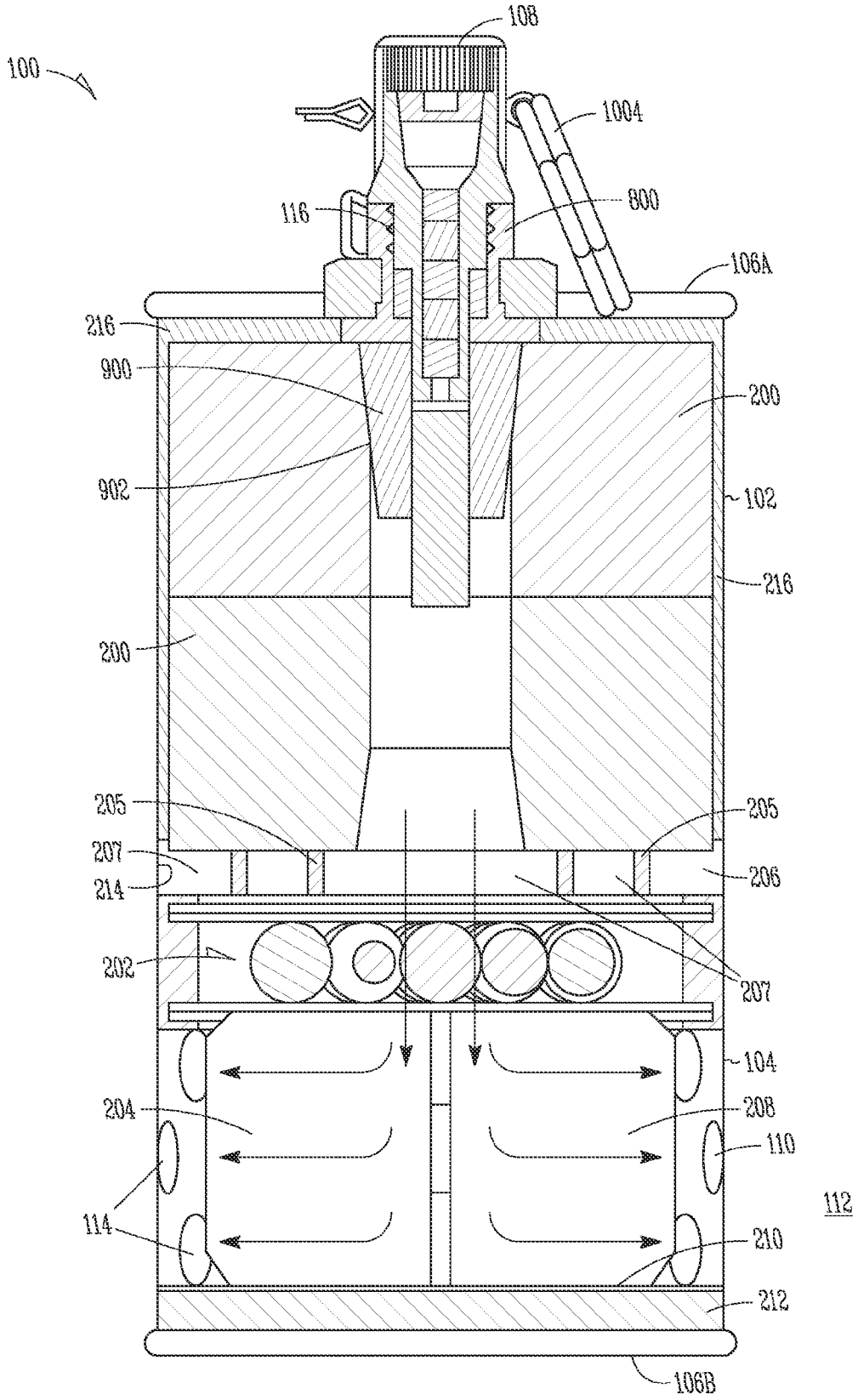
FIG. 2 is a cross-sectional view of the fire suppression device taken along the midline of the device.

One example of a portable fire suppression device 100 is shown in FIGS. 1 and 2. The fire suppression device 100 includes a container 102. In one example, the container 102 includes a perimeter surface 104, and end surface 106A, B. As shown in FIGS. 1 and 2, the container 102 has a substantially cylindrical shape with a circular cross-section. In another example, the container 102 has a non-circular cross-section, for instance, the container is faceted, square, or the like. In yet another example, the container 102 has a non-cylindrical shape (e.g., round, spherical, cubic, pyramidal or the like). The container 102, in still another example, is sized for portability. For example, the container 102 is sized for easy storage on a coat, bandoleer or the like, and is correspondingly easy to grasp with one or both hands and throw into afire. Optionally, the container is sized for transport by one or more users, and is capable of being thrown and/or rolled into afire. The container 102 is constructed with, but not limited to, steel, aluminum, flame retardant polymers, ceramics and the like. The construction materials and design of the container 102 and elements therein (described below) protect the device 100 and the fire suppression ability of the device 100 during use e.g., impacts from throwing and storage, placement within a fire and the like).

The fire suppression device 100 further includes a fire suppression agent generator 200 and a trigger mechanism 108 adapted to activate the fire suppression agent generator and thereby produce a fire suppression agent. The fire suppression agent generator 200 includes aerosol or gas emitting generators capable of producing fire suppression agent. In one example, the fire suppression generator 200 includes, but is not limited to compounds which generate inert gases, inert gas compounds having a combination of inert gases and solid particulate or the like. One option for the fire suppression agent generator 200 includes a compound having potassium carbonate. In another example, the fire suppression agent generator 200 includes a compound having an oxidizer, such as an alkali nitrate, an additive, such as dicyandiamide and a combustive binder, such as phenol-formaldehyde resin. The compound is produced by dissolving the resin in a solvent and then mixing in the oxidizer and the additive. Optionally, the compound is composed of:

- around 70, 71, 72, 73, 74, 75, 76, 77, 78, 79 or 80% (by weight or volume) potassium nitrate with an average particle size of around 5, 6, 7, 8, 9, 10, 11, 12, 13, 14, 15, 16, 17, 18, 19, 20, 21, 22, 23, 24 or 25 microns;
- around 7, 8, 9, 10, 11, 12, 13, 14, 15% resin, such as, phenol-formaldehyde resin; and
- the balance of the compound is dicyandiamide with an average particle size of around 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59 or 60 microns.

One example of the fire suppression agent generator includes an ignitable aerosol generating material in a solid form, such as a pellet. For instance, the fire suppression agent generator 200 includes an aerosol forming composite. One example of such an aerosol forming composite is described in U.S. Pat. Nos. 5,831,209; 6,042,664; 6,264,664 and 6,689,285, all of which are assigned to R-Amtech International, Inc. The aerosol forming composite includes good deformation strength characteristics, low fire-extinguishing concentration and regulated burning velocity. The pyrotechnical aerosol-forming fire-extinguishing composite contains an oxidizer, a production process additive and combustible binder formed by thermoplastic formaldehyde and phenol polycondensate, plasticized by dicarboxylic acid ester and reinforced by polytetrafluoroethylene. The composite is produced by mixing of formaldehyde and phenol polycondensate suspension in an organic solvent and polytetrafluoroethylene dispersion in dicarboxylic acid ester, mixing the resulting composition with an oxidizer and a production process additive with subsequent thermomechanical effect. The composite can be used for fire-extinguishing in different structures and devices without harmful effect on human body, living organisms and nature. The trigger mechanism 108, in another example, ignites the fire suppression agent generator 200 including the aerosol forming composite. As the composite burns, low pressure fire suppressing aerosol including solid particles is released extinguishing fires around the fire suppression device 100. The fire suppression agent generator 200 is non-explosively burned to produce a steady stream of solid particle fire suppression agent. Because the generator 200 does not explode the container 102 does not need reinforcement and/or heavy materials. Instead, the container 102 is relatively lightweight and easy to throw and wear on the user.

Another example of an aerosol forming compound includes a combustible binder formed with a polycondensate of formaldehyde and a organic compound, of a fraction from 70 to 120 microns. The oxidizing agent is an alkali nitrate of a fraction (e.g., particle size) from 15 to 25 microns. A coolant additive includes dicyandiamide, and dicyandiamide is a fraction from 40 to 80 microns. Subsequently, there is added to the above, respective fractions of the combustible binder of 10 to 25 microns of the oxidizing agent of 1 to 7 microns and of the dicyandiamide of 7 to 15 microns. The weight ratios of the fractions of combustible binder, oxidizing agent and dicyandiamide are 70:30, 25:75 and 80:20. The resulting mixture is molded while the content of the components is 9 to 20 weight percent dicyandiamide, 6 to 14 weight percent combustible binder, and the balance weight percent oxidizing agent.

In still another example, the aerosol forming composition includes potassium nitrate in a quantity of 67-72% by mass, phenolformaldehyde resin in a quantity of 8-12% by mass and dicyandiamide as the balance, wherein the particles of the potassium nitrate have a maximum average diameter of 25 microns, the particles of the phenolformaldehyde resin have a maximum average diameter of 100 microns and the particles of the dicyandiamide have a maximum average diameter of 15 microns.

The fire suppression generator 200, in another example, includes a jacket 216 extending at least part way around the fire suppression agent generator 200. In one example, the jacket 216 is coupled to the fire suppression generator 200. For instance, the jacket 216 is adhered to the generator. In another option, the jacket 216 is mechanically coupled around the generator 200 (e.g., with clamps, tape or the like). In yet another example, the jacket 216 is coupled between the interior 214 of the container 102 and the fire suppression agent generator 200. The jacket is sized and shaped, optionally, to slide into position within the container 102. The jacket 216 includes, but is not limited to, a fibrous insulating sleeve, a ceramic insulating sleeve, ceramic paper covering, a ceramic insulating mastic, epoxy, a cardboard tube or the like. Optionally, the jacket 216 is coupled with the generator using an insulating adhesive.

The jacket 216 acts as a shock absorbing member around the generator 200 that substantially prevents movement of the generator within the container 102 and protects the generator 200 from impacts during transport, storage, use or the like. The jacket 216 thereby assists in preventing the development of fractures or pulverizing of the generator 200 material. The protection provided by the jacket 216 inhibits uncontrolled burning of the generator 200 along unwanted cracks or powdered generator material. Additionally, the jacket 216 substantially prevents burning of the fire suppression agent generator 200 where the jacket 216 covers the surface of the generator 200. Similarly, the jacket 216 is not provided on the portions of the generator 200 where it is desired for burning to occur. In this way, the consumption of the generator 200 is controlled to optimize the generation of fire suppression agent and control the heat and flame generated by the generator reaction. Controlling the heat and flame of the reaction ensures the container 102 maintains its structural integrity and the fire suppression agent is directed out of the container 102 radially, as desired. (See below). Additionally, the reaction is controlled so a substantial portion of the generator 200 is consumed to produce fire suppression agent within the container 102 before the agent exits. For example, at least 80 percent of the generator 200 by weight is consumed (e.g., reacted) before exiting the container 102. In another option, at least 80 percent of the generator 200 by volume is consumed before exiting the container 102. As described below, consuming as much of the generator 200 as possible within the container 102 before unburned particles of the generator 200 can escape the container helps to optimize the generation of fire suppression agent. For instance, at least around 80% (weight or volume) or more of the generator 200 is consumed within the container 102. In still another option, 90% or more of the generator 200 is consumed within the container 102.

Referring again to FIGS. 1 and 2, the fire suppression device 100 includes a diffusing layer 202, and a ribbed support 204 that spaces the diffusing layer 202 away from the end surface 106B. The diffusing layer 202 is spaced from the fire suppression agent generator 200 and a first combustion chamber 206 is therebetween. The diffusing layer 202 is spaced from the generator 200, optionally, with a spacer 205 with passages 207 therein to allow fire suppression agent to pass through the spacer 205 toward a discharge port 110. The spacer 205 includes, but is not limited to, an insert, a snap fitting, a crimp fitting or other mechanism known to one of skill in the art to position the diffusing layer 202 at a fixed position with respect to the generator 200 and the container 102. Additionally, the spacer 205 acts as a shock absorbing member during throwing and impact of the device 100 to retain the generator 200 and the diffusing layer 202 at their installed locations within the device 100 and ensure reliable operation. In another example, the space between the diffusing layer 202 and the end surface 106B is a second combustion chamber 208. Adjacent the combustion chamber end surface, for instance the end surface 106B, are a heat shield 210 and insulation pad 212. Optionally, the combustion chamber end surface is spaced away from the end surface 106B and toward the interior of the container 102.

The fire suppression device 100 includes a discharge port 110 extending through at least a portion of the container 102. In one example, the discharge port extends around at least a portion of a perimeter of the container 102, for instance, the perimeter surface 104. As shown in FIGS. 1 and 2, in another example, the discharge port 110 includes a plurality of openings 114 extending from an interior of the device 100 (e.g., the first and/or second combustion chamber 206, 208) to the exterior 112. The openings 114, in one option, have a regular shape (e.g., circle, oval, parallelogram or the like) and form a repeating pattern (e.g., staggered, rows, columned, or the like) around the perimeter surface 104. In another option, the openings 114 have at least one of an irregular shape and an irregular pattern. In still another option, the openings 114 extend around the perimeter of a non-cylindrical fire suppression device 100, as described above. In yet another option, the container includes openings at opposed ends of the container. Optionally, the discharge port 110 is a single opening extending around at least a portion of the container 102. For instance, one or more slots are formed in the container 102 permitting ejection of the fire suppression agent during operation of the device 100. Providing the discharge port around the container 102 permits release of fire suppression agent in a plurality of directions and ensures the fire suppression agent does not provide unwanted thrust to the container 102, as described further below. In still another example, a skirt 115 is placed over the discharge port 110 to substantially prevent the entrance of dirt, moisture or the like into the fire suppression device. Optionally, the skirt 115 is placed on the interior 214 of the container 102 and occludes the discharge port 110. Ejecting fire suppression agent exits through the discharge port 110 and penetrates the skirt 115, in an example. In another example, the skirt 115 is removed prior to using the fire suppression device 100. One example of a suitable skirt 115 includes a magnetic tape that is substantially impermeable to moisture and has sufficient structural integrity to resist punctures and tearing due to normal wear (e.g., during transport, storage or the like).

Figure 3:
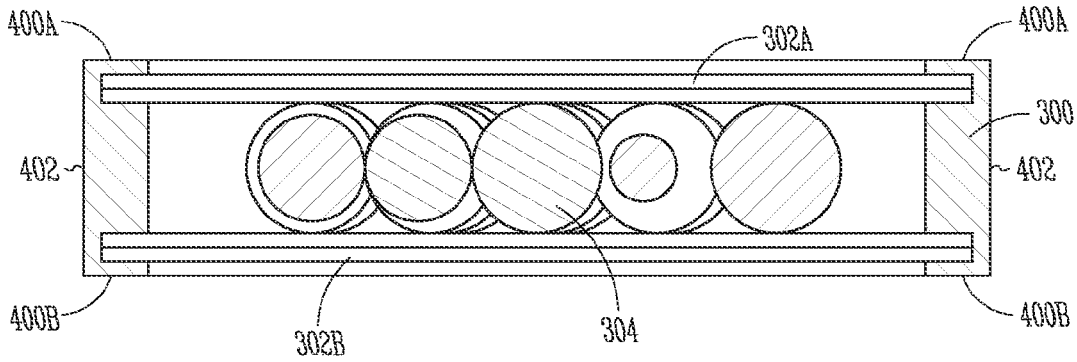
FIG. 3 is a cross-section view of one example of a diffusing layer coupled with the fire suppression device container.
Figure 4:
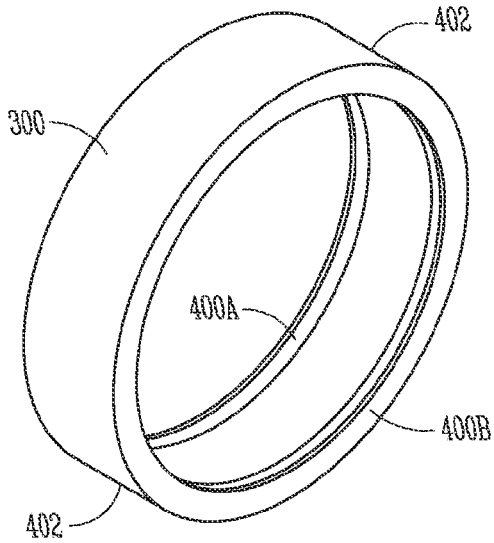
FIG. 4 is a perspective view of one example of a diffusing layer retainer.

Referring now to FIG. 3, the diffusing layer 202 is shown in greater detail as a web having a matrix of passages that the fire suppression agent passes through. The diffusing layer includes a diffusing layer frame 300 sized and shaped to compactly contain the diffusing layer within the container 102 (FIG. 1). The diffusing layer frame 300 is also shown in FIG. 4. As shown in FIG. 4, the diffusing layer frame 300, in one example, has an annular shape including flanges 400A, B. The outer surface 402 of the diffusing layer frame 300 is sized and shaped to slidably couple along an interior 214 of the container 102, in one example, for easy positioning of the diffusing layer 202 within the container 102. The diffusing layer frame 300 ensures the diffusing layer 202 is substantially prevented from moving with respect to the container 102. For instance, the frame 300 retains the diffusing layer 202 against the interior 214 of the container 102 during throwing of the device 100 and impact with a surface, such as the ground. The diffusing layer frame 300 thereby acts as a shock absorbing member that protects the diffusing layer 202 and ensures the diffusing layer 202 performs reliably after throwing and impacts of the device.

In another example, retaining screens 302A, B (e.g., wire mesh screens) are coupled within the diffusing layer frame 300. Optionally, the retaining screens 302A, B include, but are not limited to, steel wire mesh, stainless steel, high temperature resistant metals, ceramics or the like. The flanges 400A, B extend over a portion of the retaining screens 302A, B (FIG. 3), and the retaining screens 302A, B thereby capture and hold therein a diffusing material 304. By capturing the diffusing material 304 in a layer fire suppression agent formed by the generator 200 must pass through the diffusing layer 202 before exiting the fire suppression device 100.

Referring again to FIGS. 2, 3 and 4, in one example, the diffusing material 304 includes pumice stone, activated alumina, zeolite, ceramics, crushed rock such as marble, perforated metal or ceramic sheets, molded diffusing material or the like. Optionally, the diffusing material 304 is in a particulate form, for instance, pebbles, grains, balls or the like. In another example, the diffusing layer 202 includes materials 304 that oxidize the fire suppression agent after formation at the generator 200. Oxidizing the fire suppression agent, in the example, finishes the reaction of the fire suppression generator 200 and maximizes the output of the fire suppression agent. In still another example, the diffusing layer 202 interrupts flame exhaust from the fire suppression generator 200. Flame generated during burning of the fire suppression generator 200 is at least partially arrested by the diffusing layer 202 and thereby retained within the container 102. Additionally, the flame captured by the diffusing layer further combusts the fire suppression generator 200 and optimizes the output of the fire suppression agent (e.g., a fire suppression aerosol). Further, as described below, the diffusing layer 202 stirs the fire suppression agent as it passes through the layer thereby creating turbulent flow in the agent and slowing down the movement of any particles of the generator 200 that break free, thereby forcing those particles to remain in the container 102 while continuing to react (e.g., burn) and produce fire suppression agent.

Figure 5A:
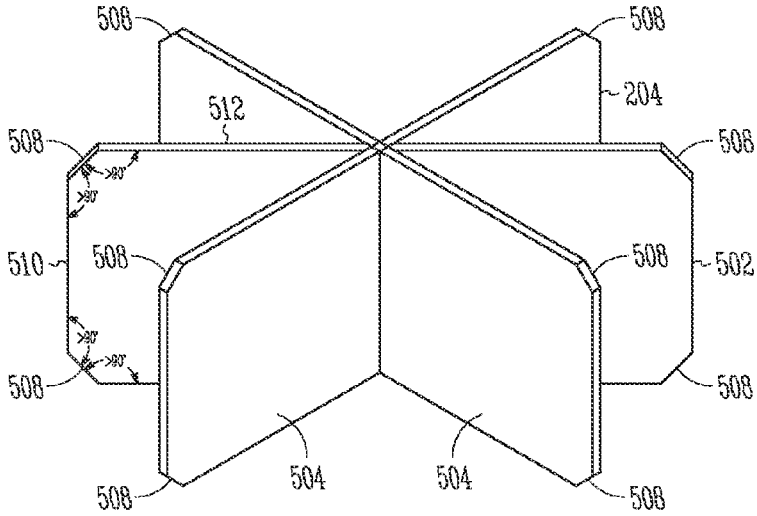
FIG. 5A is a perspective view one example of a ribbed support.

Referring now to FIGS. 5A, B, C, one example of a support, such as a ribbed support 204 is shown. As described above, the ribbed support 204 spaces the diffusing layer 202 from the combustion chamber surface adjacent the discharge port 110 (e.g., end surface 106B or surface spaced from the end surface) thereby defining the second combustion chamber 208. Additionally, the ribbed support 204 along with the spacer 205 act as shock absorbing members to retain the diffusing layer 202 within the container 102 as shown in FIG. 2 despite throwing and impacts during use of the device 100. The ribbed support 204 and the spacer 205 also prevent movement of the diffusing layer 202 into the combustion chambers 206, 208 for instance, after throwing of the device 100 and subsequent impact with the ground. The combustion chambers 206, 208 are thereby maintained after impacts to ensure the reliable functioning of the device 100.

Figure 5B:
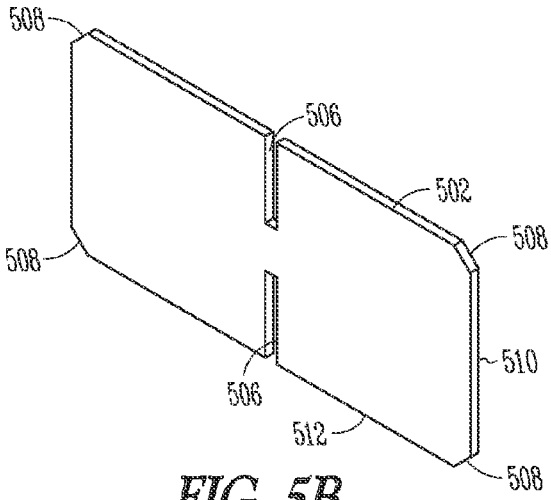
FIG. 5B is a perspective view of one example of a member of the ribbed support.
Figure 5C:
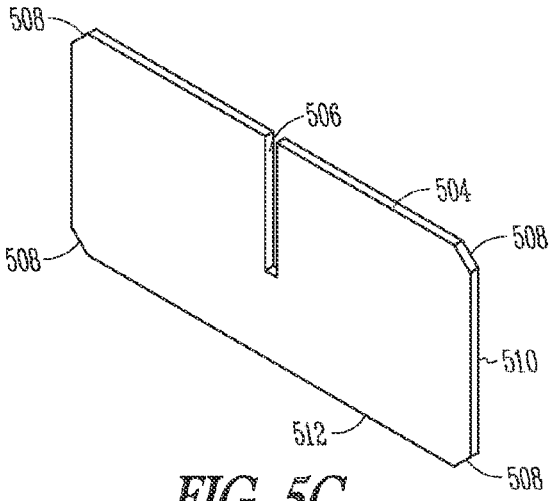
FIG. 5C is a perspective view of another example of a member of the ribbed support sized and shaped to couple with the member shown in FIG. 5C.

In one example, the ribbed support 204 includes support members 502, 504. In another example, the support members 502, 504 interconnect, for instance, with mechanical fittings, adhesives, welding or the like. As shown in FIGS. 5B, C, the support members 502, 504 include slots 506 sized and shaped to permit coupling of the support member 502 with the members 504. The support members 502, 504, in still another example, have lengths corresponding to an inner diameter of the container 102 (FIG. 2). When assembled into the ribbed support 204, the members 502, 504 snugly fit within the container interior 214. The ribbed support 204 is thereby securely held within the container 102 and is less prone to collapse during storage, transport or the like. Because the ribbed support 204 is securely held, the diffusing layer 202 is similarly securely positioned within the container 102.

The members 502, 504 of the ribbed support 204, when coupled together, form passages 514. These passage 514, in one example, direct the flow of fire suppressing agent toward the end surface 106B (e.g., heat shield 210, insulation pad 212 and surface 106B), as described below. After collision with the surface, the fire suppressing agent is directed out of the container through the passages 514 through cooperation of the surfaces of the members 502, 504 and the end surface 106B, including the heat shield 210. As described further below, the ribbed support members 502, 504 direct the fire suppression agent out from the container 102.

Referring again to FIGS. 5A, B, C, the ribbed support 204 includes outside corners 508. As shown in the figures, in one example, the outside corners 508 measure more than 90 degrees with respect to the edges 510, 512 (e.g., the ribbed support 204 is without outside corners 508 measuring 90 degrees or less). See FIG. 5A. For instance, the outside corners 508 have at least one of a chamfered configuration, rounded configuration, beveled configuration or the like. The configuration of the outside corners substantially prevents the engagement of sharp corners with features of the fire suppression device 100 including, but not limited to, the diffusing layer 202, the heat shield 210, the insulation 212, the end surface 106B or the like. As described further below, because only blunt contact is made between these features and the ribbed support 204 heated fire suppression agent from the generator 200 is less likely to force the ribbed support into contact with the features and cause penetration and failure of the container 102 or its features. The fire suppression device 100 thereby has a more reliable and effective operation.

Figure 6:
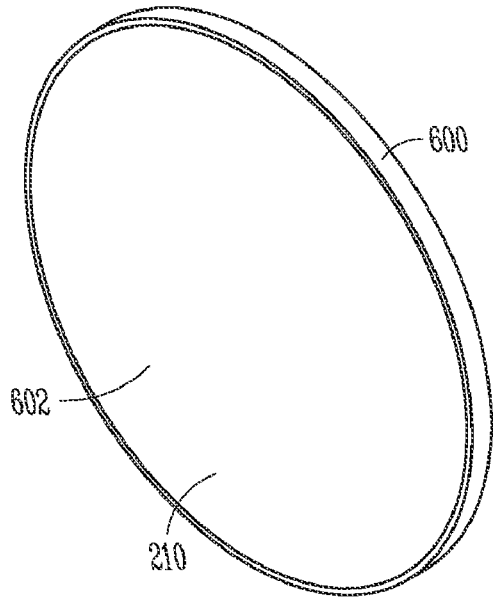
FIG. 6 is a perspective view of one example of a heat shield.
Figure 7:
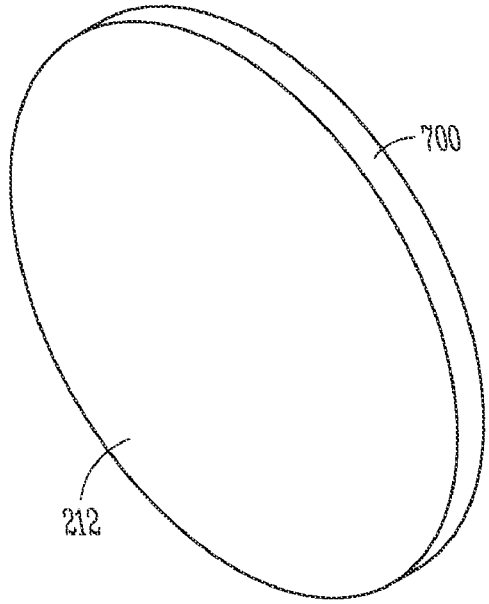
FIG. 7 is a perspective view of one example of an insulation pad.

Referring now to FIGS. 6 and 7, examples of a heat shield 210 and an insulation pad 212 are shown. As shown in FIG. 2, in one example, the heat shield 210 is positioned relatively above the insulation pad 212. The ribbed support 204 is positioned above the heat shield 210 and defines the second combustion chamber 208 between the diffusing layer 202 and the shield 210. The heat shield 210 and the insulation pad 212 include perimeters 600, 700, respectively, that substantially correspond to the interior cross sectional area of the container 102, in another example. When positioned in the container 102, the heat shield 210 and the insulation pad 212 are thereby snugly held by the interior 214 of the container.

In one example, the heat shield 210 is constructed with materials that absorb heat and protect the end surface 106B. The heat shield 210 includes, but is not limited to, a ceramic plate, a ceramic paper, a glass fiber plate, a paper or cardboard coated with ceramic insulating mastic or other coating with insulating characteristics, such as Fireaway LLC Guardian fire retardant paint, or the like. In another example, the insulation pad 212 is constructed with a high temperature resistant and pliable insulation material, fire retardant paint or the like. For instance, the insulation pad 212 includes, but is not limited to, KAOWOOL a registered trademark of Thermal Ceramics, Inc. In yet another example, the insulation pad 212 includes INSWOOL a registered trademark of A. P. Green Industries, Inc. The heat shield 210 and the insulation pad 212 cooperate to protect the end surface 106B (FIG. 2) from the heated fire suppression agent created during activation of the fire suppression generator 200. As described above, the fire suppression agent travels through the diffusing layer 202, and then into the second combustion chamber 208, in one example. The fire suppression agent collides with the container surface, such as the heat shield 210, and is then ejected radially out of the container 102 through the discharge port 110. The fire suppression agent travels in an oblique direction relative to its path between the first combustion chamber 206 and the discharge port 110 (see the arrows in FIG. 2). That is to say the fire suppression agent diverges from its original course from the first combustion chamber 206 and through the diffusing layer 202 after being incident with the container surface. In another example, the fire suppression agent is directed out of the container 102 at an oblique angle with respect to its original flow direction from the first combustion chamber 206, for instance, at an angle between more than around 0 degrees and less than around 180 degrees. In yet another example, the fire suppression agent is directed out of the container 102 at an oblique angle with respect to its original flow direction from the first combustion chamber 206, for instance, at an angle between more than around 45 degrees and less than around 145 degrees.

As the fire suppression agent collides with a surface 602 of the heat shield 210 heat transfer takes place. The heat shield 210 and the insulation pad 212 ensure the end surface 106B is protected from a proportion of this heat. The end surface 106B thereby is protected from melting and subsequent failure of the surface 106B by the pressure of the fire suppression agent. Moreover, the heat shield surface 602 that meets the oncoming fire suppression agent assists in making the flow of fire suppression agent turbulent. As described further below, the turbulent flow stirs the agent, thereby slowing the movement of the agent, and assists in consuming free particles of the generator 200 before exiting the container 102 (FIGS. 1 and 2). Additionally, the collision assists in breaking up particles of the generator 200 before they exit the container 102. This increases the surface area of the particles and facilitates additional consumption of the generator 200 (and generation of fire suppression agent) before the particles exit the container 102.

Figure 8:
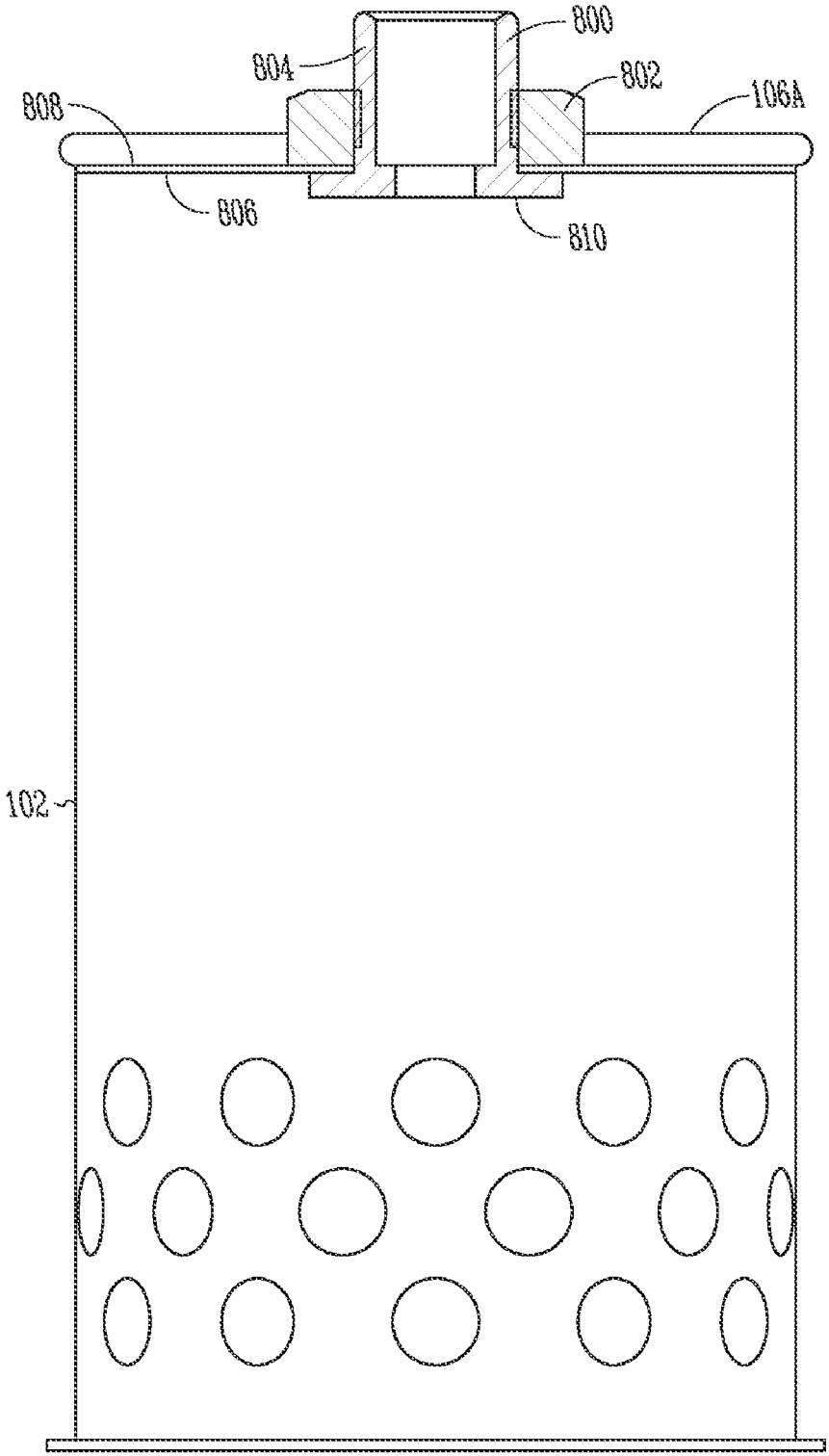
FIG. 8 is a cross-section view of the fire suppression device taken along the midline of the device including examples of a trigger mechanism adaptor and a locking nut.

FIG. 8 shows a cross section of the container 102 with at least some of the inner features of the fire suppression device 100 removed. A trigger mechanism adaptor 800 and an optional retaining member, such as a locking fastener 802, are shown coupled to the container end surface 106A. The locking fastener 802, in one example, couples around the trigger mechanism adaptor 800 and holds the adaptor 800 in place on the end surface 106A. For instance, a neck 804 of the adaptor is fed through the end surface 106A from an interior side 806, and the locking fastener 802 is coupled around the neck 804 from the opposing side 808 (exterior) of the end surface 106A. A flange 810 of the adaptor 800 cooperates with the locking fastener 802 to hold the adaptor 800 in place. In still another example, the locking fastener 802 is coupled from the interior side 806 and the adaptor 800 is coupled from the exterior side 808. In another option, the adaptor 800 is coupled with the container by welding, threaded coupling or the like. The trigger mechanism adaptor 800 includes an adaptor barrel 812 sized and shaped to receive a portion of the trigger mechanism 108 (FIGS. 1 and 2) and snugly hold the mechanism 108 in place. Optionally, the trigger mechanism 108 and the adaptor 800 include features including, but not limited to, threading, adhesives or the like to couple the trigger mechanism 108 with the adaptor 800 and the fire suppression device 100. As shown in FIG. 2, the trigger mechanism 108 and the adaptor 800 include threading 116.

Figure 9:
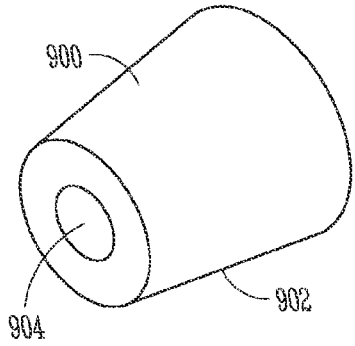
FIG. 9 is a perspective view of one example of a retaining plug.

Referring now to FIG. 9, another example of a retaining member, such as an optional anchoring plug 900, is shown. The anchoring plug 900 includes, optionally, a tapered outer surface 902. A plug barrel 904 extends through the plug 900 and is sized and shaped to snugly receive the trigger mechanism 108 (FIGS. 1 and 2). In yet another example, the plug 900 is coupled with the trigger mechanism 108 by a threaded coupling, a mechanical fitting, a weld, an adhesive or the like. As shown in FIG. 2, the tapered outer surface 902 of the anchoring plug 900 is seated against the fire suppression generator 200 and forms an interference fit with the generator 200. The interference fit of the anchoring plug 900 cooperates with the jacket 216 to snugly house the fire suppression agent generator 200 within the container 102 (FIG. 2). In one example, the anchoring plug 900 is constructed with a pliable material having sufficient resistance to heat to substantially resist ignition, such as, a flame resistant elastomer (e.g., a silicone rubber, flame resistant plastic, such as phenolic, or the like) that deforms when seated against the generator 200, and thereby securely holds the generator 200. In another example, the anchoring plug 900 includes, but is not limited to, die-cast or machined metals, such as zinc, aluminum or the like. Additionally, the trigger mechanism 108 is securely held within the container 102 by the interference fit between the anchoring plug 900 and the generator 200.

The retaining members described above (e.g., anchoring plug 900 and locking fastener 802) ensure the trigger mechanism 108 and the generator 200 are securely held within the fire suppression device 100. The retaining members act as shock absorbing members to protect the generator 200 from impact through transport, storage, throwing use or the like. The secure retention of the trigger mechanism 108 and the generator 200 assists in improving the reliability of the device operation and optimizes generation of the fire suppression agent as fractures or the like are prevented in the generator material. Optionally, the fire suppression device 100 relies solely on the jacket 216 to securely retain the generator 200 in place, as previously described above.

Figure 10:
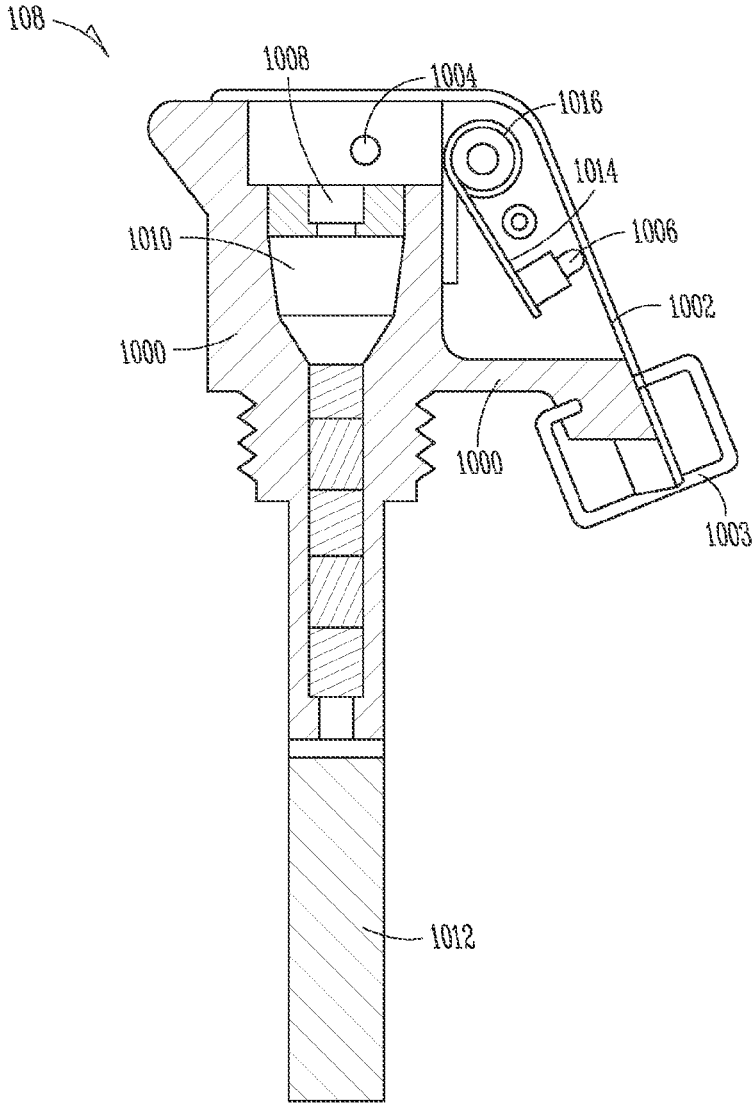
FIG. 10 is a cross-sectional view of one example of the trigger mechanism.

Referring now to FIG. 10, one example of the trigger mechanism 108 is shown. The trigger 108 mechanism includes a housing 1000 that contains an arm 1002 and a safety pin 1004 (see also FIG. 2). The safety pin 1004 is coupled with the arm 1002 and the housing 1000 to prevent movement of the arm 1002 without removal of the pin 1004. In another example, the trigger mechanism 108 includes a redundant safety feature, including, but not limited to, a thumb actuated safety, a safety clip 1003, or the like (see below). As shown in FIG. 10, the safety clip 1003 is coupled between the trigger mechanism housing 1000 and the arm 1002.

The trigger mechanism 108 further includes, in one example, a striking pin 1006 sized and shaped to contact a primer 1008. The striking pin 1006, in another example, is coupled with an arm 1014. The arm 1014 is coupled with a biasing element 1016, such as a spring. The primer 1008 is retained within the housing 1000 and is disposed above a time-delayed activator, such as at least one delay fuse 1010. The delay fuse 1010 delays ignition of the ignition material 1012 disposed underneath the delay fuse 1010 and in close proximity to the fire suppression agent generator 200 (FIG. 2). A user is thereby able to position the fire suppression device 100, such as, by throwing, rolling, or the like, before the device begins emitting fire suppression agent.

Upon removal of the safety pin 1004 (e.g., by manually pulling the pin) and release of the arm 1002, the striking pin 1006 is rotated by the biasing element 1016 and struck against the primer 1008 causing ignition of the primer 1008. Optionally, where the trigger mechanism 108 includes the redundant safety feature (e.g., safety clip 1003), the safety feature must first be deactivated, such as by removing the clip 1003, before removal of the safety pin 1004 will release the arm 1002. The primer 1008 then ignites the delay fuse 1010. After the delay fuse 1010 has been consumed, the fuse 1010 ignites the ignition material 1012, and the ignition material ignites the fire suppression agent generator 200. The optional combination of the safety pin 1004 and redundant safety feature provides a dual system that assists in preventing accidental use of the fire suppression device. Removal of the safety pin and the redundant safety feature is required to activate the fire suppression device 100. In yet another example, the arm 1002 is removed for ease of operation of the fire suppression device. Optionally, the fire suppression device 100 is constructed without a delay fuse. In another example, the redundant safety feature includes a latch, such as a thumb latch, as a secondary safety.

In other examples, the trigger mechanism 108 includes, but is not limited to, an electrical activation system, a mechanical activation system, a chemical activation system, a manual activator or the like. For instance, the fire suppression generator 200 is ignited with an electrical arc. In another example, the fire suppression generator 200 is ignited with sparks generated by drawing flint across steel. In still another example, the fire suppression generator 200 is ignited with sparks or flames generated by a chemical reaction, such as heated magnesium, a vial of acid adjacent a pyrotechnic device that is ignited by the acid or the like.

In one example of operation of the fire suppression device 100 (FIGS. 1, 2 and 10), the arm 1002 is released, and the safety pin 1004 is removed from the device 100. The biasing element 1016 moves the striking pin 1006 into engagement with the primer 1008. The primer 1008 ignites, and in another example, ignites at least one delay fuse 1010. As the delay fuse 1010 burns, the user may position the fire suppression device 100 within or near a fire. For instance, the user may throw the device, roll the device, launch the device or the like. After burning for a specified period, the delay fuse ignites the ignition material 1012, and the ignition material in turn ignites the fire suppression agent generator 200.

Referring now to FIG. 2, after ignition, the fire suppression agent generator 200 is consumed. Only exposed surfaces of the generator 200 initially burn. For instance, the jacket 216 covers at least a portion of the generator 200, in one example. Those concealed surfaces do not initially ignite. The fire suppression generator 200 is thereby consumed in a controlled manner to ensure the generator is fully consumed and the volume and quality (i.e., fire suppressant ability) of the fire suppression agent is optimized. Additionally, the generator 200 is consumed in a controlled manner to ensure the reaction of the generator 200 does not damage the container 102 (e.g., split open the container and allow fire suppression agent to exit uncontrollably).

The fire suppression agent is formed by the generator 200 in the first combustion chamber 206 (e.g., a reaction chamber for consumption of the generator to at least partially occur in). The first combustion chamber 206 provides space for the reaction of the generator to take place and provides a flow path for the fire suppression agent toward the discharge port 110. As previously described the spacer 205, in one example, is inserted between the generator 200 and the diffusing layer 202 to form the first combustion chamber. The spacer 205 assists the diffusing layer 202 in preventing large particles of the generator 200 from breaking free and traveling through the diffusing layer 202. As described above, in one example, the fire suppression agent then passes through the diffusing layer 202. Referring now to FIG. 3, the diffusing material 304 oxidizes the fire suppression agent and still-burning particles of the generator 200 and thereby assists in optimizing the completion of the reaction of the generator in the container 102. Additionally, the diffusing material 304 absorbs at least some of the heat in the fire suppression agent before the agent exits the container 102. Moreover, the diffusing layer 202 stirs the fire suppression agent as is passes through the layer, causing turbulence. The turbulence slows the exit of the fire suppression agent along with small particles of the generator 200 that have broken free, allowing the reaction of the generator 200 to continue before exiting the container 102. In another example, the reaction of the generator 200 may generate flames, and the diffusing layer 202 assists in containing those flames prior to exiting the device 100, as the burning reaction is forced to continue within the container 102. The flames are thereby at least partially concealed within the container 102.

As described above, the fire suppression device 100 optionally includes a second combustion chamber 208. After passing through the diffusing layer 202, the fire suppression agent enters the second combustion chamber 208 and the burning reaction of the fire suppression agent generator 200 is allowed to continue and substantially finish before exiting the container 102. As the fire suppression agent enters the second combustion chamber 208 it passes over the ribbed support 204 and collides with the end surface 106B (e.g., the end surface, heat shield 210, insulation pad 212 or the like) of the container 102. The fire suppression agent experiences turbulence as it moves over the support 204 and is incident against the end surface 106B. Turbulence slows down the fire suppression agent, and permits the reaction of the generator 200 to continue within the container 102 prior to exiting through the discharge port 110. Any flames created from the generator 200 reaction are also thereby substantially retained within the container 102.

The ribbed support 204 with its blunt outside corners 508 experiences thrust from the fire suppression agent. Penetration of the container end surface 106B (e.g., end surface, heat shield 210, insulation pad 212 or the like) is substantially prevented because the ribbed support 204 is without sharp corners. The ribbed support 204 and the end surface 106B cooperate to direct the fire suppression agent outwardly toward the interior 214 of the container 102, and then out of the discharge port 110.

The fire suppression agent is directed out of the container 102 through the discharge port 110. As described above, the discharge port 110 extends at least part way around the perimeter of the container 102. In one example, the discharge port 110 includes a plurality of openings 114 that allow the fire suppression agent to radially exit the device. In another example, the discharge port 110 includes openings that permit exit of the fire suppression agent in at least two opposing directions so any thrust created by the exiting agent is countered by opposed thrust from agent exiting in another direction (e.g., there is no net thrust). The fire suppression device 100 thereby remains where it is placed after activation, for instance near a fire. The device 100 remains stationery whether it is on a side or end (e.g., perimeter surface 104, end surface 106A, B, or the like). Additionally, the dispersion of the fire suppression agent in more than one direction (e.g., radially, across an arc, at discrete locations around the device, or the like) assists in ensuring that the agent is able to escape and interact with a fire despite having a portion of the discharge port 110 occluded, for instance, due to debris.

Additionally, the cooling of the fire suppression agent due to heat transfer with the diffusing layer 202 and end surfaces 106B (including the heat shield 210 and insulation pad 212), as previously described, allows the agent to collide with the end surface 106B without melting the container 102 and possibly causing failure. The diffusing layer 202 and the heat shield 210 and insulation pad 212 at the end surface 106B sufficiently cool the fire suppression agent for use in a smaller portable container 102. In another example, without at least some of these features, the heated fire suppression agent could melt a portion of the portable container and the thrust of the agent could cause the container to fail. In yet another example, the turbulence generated in the container 102 permits the use of a smaller diffusing layer, for instance, having a single layer of diffusing material because cooling and completion of the reaction of the generator are completed by the diffusing layer in combination with the end surface 106.

Figure 11:
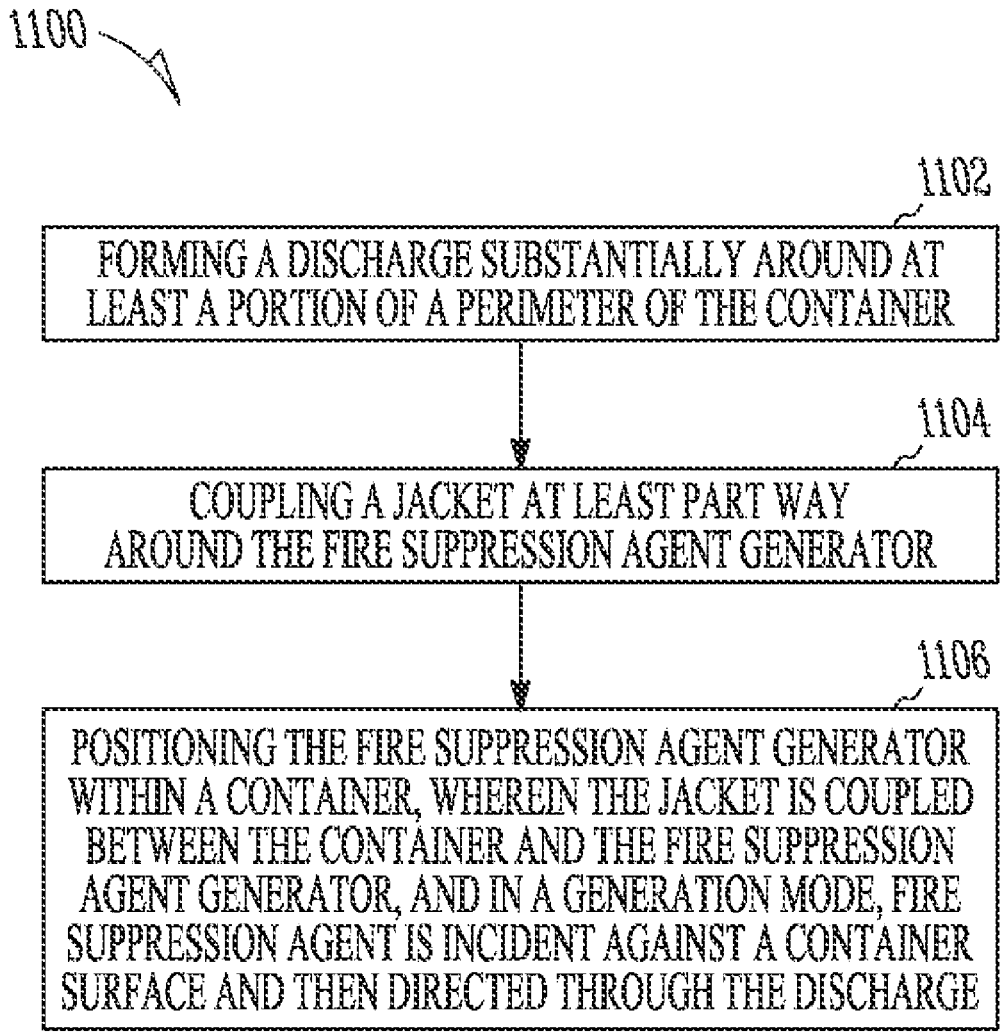
FIG. 11 is a block diagram showing one example of a method for making a fire suppression device.

FIG. 11 is a block diagram showing one example of a method 1100 for making a fire suppression device. Reference is made to the fire suppression device 100 and the examples of its components as described above. At 1102, a discharge port 110 is formed substantially around at least a portion of the container 102, for instance, the container perimeter surface 104. At 1104, a jacket 216 is coupled at least part way around a fire suppression agent generator 200. At 1104, the fire suppression agent generator 200 is positioned within the container 102. The jacket 216 is coupled between the container and the fire suppression agent generator. In a generation mode, fire suppression agent is incident against a container surface (e.g., heat shield 210) and then directed through the discharge port 110.

Several options for the method 1100 follow. In one example, forming the discharge port 110 includes forming a plurality of openings 114 substantially around the perimeter 104 of the container 102. In another example, the method 1100 includes coupling a ribbed support 204 between the container surface 106B and the fire suppression agent generator 200. In yet another example, coupling the ribbed support 204 includes spacing the container surface 106B from a diffusing layer 202 within the container 102. Spacing the container surface 106B from the diffusing layer 202 includes, optionally, forming a first combustion chamber 206 between the diffusing layer 202 and the fire suppression agent generator 200, and forming a second combustion chamber 208 between the container surface 106B and the diffusing layer 202. The method 1100 includes, in still another example, engaging beveled outside corners 508 of the ribbed support 204 with the container surface (e.g., heat shield 210, insulation pad 212, end surface 106B or the like). Optionally, coupling the ribbed support 204 includes forming a plurality of passages between the ribbed support and the container that direct fire suppression agent against the container surface and subsequently through the discharge port.

In another example, positioning the fire suppression agent generator 200 within the container 102 includes holding the fire suppression agent generator 200 immobile between a retaining member. In one example, holding the fire suppression agent generator 200 immobile includes at least one of coupling a locking fastener 802 with the container 200 and seating a plug 900 against the fire suppression agent generator. In still another example, the method 1100 includes positioning a heat shield 210 and insulation pad 212 along the container surface 106B.

The above described fire suppression device is a portable apparatus that discharges fire suppression agent in multiple directions to ensure there is substantially no net thrust. Because the fire suppression device experiences little if any thrust, the device remains where it is positioned, for instance, adjacent to a fire. Further, because of the zero net thrust of the device (e.g., agent is discharged in at least two opposed directions) the container and elements of the device are lightweight and compact without needing heavy weight components to ensure the container stays in the desired location. Additionally, ejecting the fire suppression agent in multiple directions ensures the device provides the agent despite a portion of the discharge port being occluded, for example, by debris or the device landing on a side surface.

Further, because the fire suppression device uses the heat transfer of the diffusing layer and the collision of the fire suppression agent with an end surface of the device container the fire suppression agent is sufficiently cooled to prevent damage to the container, such as melting, and possible failure due to thrust. A small and portable container (e.g., grasped and thrown with one hand) is thereby able to generate a large amount of fire suppression agent without needing additional space and/or a more robust container to house the reaction and thereby cool the agent to protect the container. Additionally, the turbulence stirs the fire suppression agent and slows the agent as it moves through the container allowing particles to continue burning before exiting the container. The reaction of the fire suppression agent generator, including large particles that break free from the generator is thereby substantially contained within the device. This arrests the flame generated while burning the generator, and substantially contains and conceals the flame within the container. Moreover, the reaction of the generator is more fully completed within the container, thereby optimizing the output of fire suppression agent, such as a solid particle containing aerosol.

In one example, the fire suppression generator is at least partially covered with a jacket. The jacket protects the fire suppression generator during transport, storage and use (e.g., throwing and rolling) and assists in absorbing sufficient shock to avoid fracture and pulverizing of the generator. Furthermore, the jacket, in another example, inhibits the reaction of the generator along whatever portion of the generator it is coupled. The reaction of the fire suppression generator is thereby inhibited to control the rate at which fire suppression agent is generated. Controlling the reaction correspondingly controls the temperature of the container, and helps protect the container from damage. Additionally, slowing the reaction ensures the amount of fire suppression agent generated is optimized, for instance by limiting the thrust of the generated fire suppression agent and thereby minimizing the amount of particles from the generator blown out of the container by the thrust of the agent before burning.

Moreover, the fire suppression agent generator includes a compact lightweight solid pellet to generate the agent as opposed to a large volume of heavy liquid, such as water. The fire suppression agent generator produces a low pressure solid particle aerosol by non-explosively burning the generator. Because the fire suppression agent generator does not explosively produce the agent, the container is made more compact and lightweight while still producing voluminous fire suppression agent. Further still, the solid generator provides a single compact non-explosive device to generate the fire suppression agent. A liquid reservoir and a separate explosive device to push and atomize the liquid are thereby not needed.

In another example, the fire suppression device includes the ribbed support that spaces the diffusing layer from an end surface of the second combustion chamber adjacent the discharge port to thereby form a second combustion chamber. The second combustion chamber provides additional space for the reaction of the fire suppression generator to take place, and also assists in arresting flames that make it past the diffusing layer. The ribbed support optionally includes outside corners measuring more than 90 degrees with respect to the edges of the support members (e.g., the outside corners have a chamfered, rounded, beveled configuration or the like). As fire suppression agent is generated, the outside corners bluntly contact the container end surface and substantially prevent puncture of the container end surface due to thrust caused by the heated fire suppression agent. Failure of the end surface is thereby substantially prevented allowing continued discharge of the fire suppression agent obliquely after collision with the end surface. The outside corners of the ribbed support, the combustion chambers, the diffusing layer, and the turbulence generated by the features of the fire suppression device cooperate to protect the container from failure and ensure the fire suppression agent is discharged as desired (e.g., in multiple directions with no net thrust).

The rugged construction of the fire suppression device components protects the device and ensures reliable operation of the device during rough transport, storage and use including throwing and subsequent impact with the ground, debris or the like. For example, the jacket surrounding the fire suppression agent generator acts as a shock absorbing member to protect the generator and prevent fracture. In another example, the anchoring plug is engaged against an inner surface of the generator and acts as a shock absorbing member for the generator. The anchoring plug substantially prevents undesired movement of the generator. In other examples, the device includes a frame and screen assembly around the diffusing material to contain the material in the desired location of the container. The frame ensures the diffusing layer is snugly coupled with the container wall to prevent unwanted movement of the layer. Additionally, the device includes shock absorbing members such as the spacer and the ribbed support to retain the diffusing layer and the fire suppression generator in their desired locations and prevent movement of these elements into the combustion chambers. These shock absorbing members, alone or in combination, protect the elements of the fire suppression device from impacts and ensure reliable operation of the device after throwing.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A fire suppression device, comprising:

a container having container walls;

a solid fire suppression agent generator;

a trigger mechanism configured to initiate generation of a fire suppression agent from the solid fire suppression agent generator;

a plurality of discharge ports configured to release the fire suppression agent; and a solid fire suppression agent generator support assembly comprising:

a jacket extending across and engaged along a first end surface of the solid fire suppression agent enerator, the jacket extends at least part way around the solid fire suppression agent generator and is coupled between the solid fire suppression agent generator and a container side wall; and a shock-absorbing, spacer extending across and engaged along a second end surface of the solid fire suppression agent generator;

wherein the shock-absorbing spacer defines a plurality of passages along the second end surface of the solid fire suppression agent generator, the plurality of passages include at least a first passage wall disposed near a perimeter of the solid fire suppression agent generator, and a second passage wall spaced apart from the first passage wall and from the perimeter of the solid fire suppression agent generator.

2. The fire suppression device of claim 1, wherein the solid fire suppression agent generator support assembly spaces the solid fire suppression agent generator away from the container walls.

3. The fire suppression device of claim 1, wherein the shock-absorbing spacer includes a diffusing layer coupled between the solid fire suppression agent generator and the plurality of discharge ports, the diffusing layer is configured to agitate the fire suppression agent.

4. The fire suppression device of claim 1, wherein the shock-absorbing spacer includes a heat shield configured to protect at least one container wall from heat.

5. The fire suppression device of claim 1, wherein the shock-absorbing spacer includes a ribbed support coupled between the solid fire suppression agent generator and the plurality of discharge ports, the ribbed support including a plurality of passages configured to distribute the fire suppression agent through the plurality of discharge ports.

6. The fire suppression device of claim 1, wherein the shock-absorbing spacer includes a pliable insulation pad.

7. The fire suppression device of claim 6, wherein the pliable insulation pad is configured to form a combustion chamber between the solid fire suppression agent generator and the plurality of discharge ports.

8. The fire suppression device of claim 6, wherein the pliable insulation pad is configured to direct the fire suppression agent toward the plurality of discharge ports.

9. The tire suppression device of claim 1, wherein the jacket is configured to substantially inhibit generation of the fire suppression agent along portions of the solid fire suppression agent generator coupled to the jacket.

10. The fire suppression device of claim 1, wherein the jacket includes an insulating adhesive configured to couple the solid fire suppression agent generator and one or more container walls.

11. The fire suppression device of claim 1, wherein the plurality of discharge ports are configured to release the fire suppression agent in a substantially radial manner about the container.

12. A fire suppression device, comprising:

a container having container walls;

a solid fire suppression agent generator suspended within the container, the solid fire suppression agent generator is at least partially surrounded by the container and is axially and radially spaced apart from the container walls;

a trigger mechanism configured to initiate generation of a fire suppression agent from the solid fire suppression agent generator; and a plurality of discharge ports, in at least one of the container walls, configured to release the fire suppression agent;

wherein the solid fire suppression agent generator is axially spaced apart from a first container end wall using a first shock-absorbing spacer that extends over and is engaged with a first end surface of the solid fire suppression agent generator; and wherein the solid fire suppression agent generator is axially spaced apart from a second container end wall using a second shock-absorbing spacer, the second shock-absorbing spacer includes a first passage wall, disposed near an outer perimeter of the solid fire suppression agent generator, and at least a second passage wall, disposed interiorly to the first passage wall, the first and second passage walls bound at least one of a plurality of passages.

13. The fire suppression device of claim 12, wherein the plurality of discharge ports is configured to discharge the fire suppression agent in a substantially radial mariner such that, in a generation mode, the container experiences no net thrust.

14. The fire suppression device of claim 12, including a diffusion layer configured to agitate the fire suppression agent.

15. The fire suppression device of claim 12, wherein the solid fire suppression agent generator suspended within the container is radially spaced apart from a container side wall using at least a portion of the first shock-absorbing spacer, the at least a portion of the first shock-absorbing spacer substantially radially surrounds the fire suppression agent generator.

16. The fire suppression device of claim 12, wherein at least one of the first or second shock-absorbing spacers is configured to retain the fire suppression agent generator at a fixed location within the container.

17. The fire suppression device of claim 12, wherein the second shock-absorbing spacer extends across and is engaged with a second end surface of the solid fire suppression agent generator.

18. The fire suppression device of claim 12, wherein in a generation mode, the solid fire suppression agent generator is substantially consumed within the container.

19. The fire suppression device of claim 12, including an anchoring plug coupled to the trigger mechanism and an inner surface of the solid fire suppression agent generator.

20. The fire suppression device of claim 12, including a ribbed support, coupled between the solid fire suppression agent generator and the plurality of discharge ports, the ribbed support including a plurality of passages configured to distribute the fire suppression agent through the plurality of discharge ports.

21. The fire suppression device of claim 1, wherein the second passage wall is disposed near a central portion of the second end surface of the solid fire suppression agent generator.

22. The fire suppression device of claim 12, wherein the at least one of the plurality of passages extends along a second end surface of the solid fire suppression agent generator.

* * * * *

UNITED STATES PATENT AND TRADEMARK OFFICE

CERTIFICATE OF CORRECTION

PATENT NO. : 8,146,675 B2
APPLICATION NO. : 12/946569
DATED : April 3, 2012
INVENTOR(S) : Marc V. Gross et al.

It is certified that error appears in the above-identified patent and that said Letters Patent is hereby corrected as shown below:

In the Specifications:

In column 3, line 37, delete “e.g.,” and insert -- (e.g., --, therefor.

In the Claims:

In column 15, line 43, in Claim 1, delete “enerator,” and insert -- generator, --, therefor.

In column 15, line 48, in Claim 1, delete “absorbing,” and insert -- absorbing --, therefor.

In column 16, line 19, in Claim 9, delete “tire” and insert -- fire --, therefor.

In column 16, line 59, in Claim 13, delete “mariner” and insert -- manner --, therefor.

Signed and Sealed this
Fourth Day of September, 2012

David J. Kappos

David J. Kappos
*Director of the United States Patent and Trademark Office*